US007735682B1

(12) United States Patent
Cassel et al.

(10) Patent No.: US 7,735,682 B1
(45) Date of Patent: Jun. 15, 2010

(54) WRIST-WORN WIPES DISPENSER

(76) Inventors: Stacy Cassel, 251 E. Woodland Ave., Springfield, PA (US) 19064; Eileen Longo, 37 Brandywine Ct., Egg Harbor Township, NJ (US) 08234

( * ) Notice: Subject to any disclaimer, the term of this patent is extended or adjusted under 35 U.S.C. 154(b) by 445 days.

(21) Appl. No.: 11/410,238

(22) Filed: Apr. 24, 2006

(51) Int. Cl.
*B65H 1/00* (2006.01)

(52) U.S. Cl. ..... 221/185; 221/24; 221/33; 221/63; 221/155; 221/307; 224/219

(58) Field of Classification Search ..... 221/1–312 C; 224/219, 221, 267
See application file for complete search history.

(56) References Cited

U.S. PATENT DOCUMENTS

| | | | | | |
|---|---|---|---|---|---|
| 1,445,528 | A | * | 2/1923 | Marsh | 224/222 |
| 2,347,823 | A | * | 5/1944 | Goodman et al. | 312/50 |
| 2,449,324 | A | * | 9/1948 | Robinson | 224/219 |
| 3,223,281 | A | * | 12/1965 | Larkin | 221/46 |
| 3,329,309 | A | * | 7/1967 | May | 221/63 |
| 3,826,407 | A | * | 7/1974 | Keating | 221/63 |
| 4,341,331 | A | * | 7/1982 | McDougall | 224/219 |
| 4,401,233 | A | * | 8/1983 | Frey | 221/36 |
| 4,462,116 | A | * | 7/1984 | Sanzone et al. | 2/170 |
| 4,502,298 | A | * | 3/1985 | Benton | 63/1.14 |
| 4,536,889 | A | | 8/1985 | Taylor et al. | |
| 4,805,242 | A | * | 2/1989 | Bolton | 2/160 |
| 5,011,536 | A | | 4/1991 | Boom | |
| 5,127,545 | A | * | 7/1992 | French | 221/102 |
| D335,023 | S | * | 4/1993 | Hutcheson | D2/612 |
| 5,318,371 | A | * | 6/1994 | Niewulis | 401/6 |
| 5,323,554 | A | * | 6/1994 | MacDonald | 40/633 |
| 5,358,141 | A | | 10/1994 | Carlson et al. | |
| 5,401,547 | A | * | 3/1995 | Blackwell et al. | 428/41.8 |
| 5,413,126 | A | * | 5/1995 | Revson | 132/275 |
| 5,669,529 | A | * | 9/1997 | Levit | 222/78 |
| 5,671,481 | A | * | 9/1997 | Giard | 2/170 |
| 5,871,132 | A | * | 2/1999 | Hargreaves | 224/576 |
| 6,105,837 | A | * | 8/2000 | Teed | 224/181 |
| 6,237,611 | B1 | * | 5/2001 | LeCrone et al. | 132/275 |
| 6,263,885 | B1 | * | 7/2001 | Levy | 132/275 |
| 6,349,414 | B1 | * | 2/2002 | Tillman | 2/170 |
| 6,427,839 | B1 | * | 8/2002 | Helfer-Grand | 206/494 |
| 6,443,341 | B1 | * | 9/2002 | Rittmann | 224/219 |
| 6,550,635 | B1 | * | 4/2003 | King et al. | 221/49 |
| 7,316,332 | B2 | * | 1/2008 | Powers et al. | 222/175 |
| 2002/0084279 | A1 | * | 7/2002 | Lickstein | 221/24 |
| 2002/0162848 | A1 | * | 11/2002 | Na | 221/63 |

* cited by examiner

*Primary Examiner*—Gene Crawford
*Assistant Examiner*—Michael K Collins
(74) *Attorney, Agent, or Firm*—Norman E. Lehrer

(57) ABSTRACT

A wipes dispenser includes a generally tubular transparent housing adapted to be worn about a person's wrist with a plurality of wipes contained within the housing. The housing also has an opening through which the wipes are dispensed. In a second embodiment, the opening may be covered with a hinged resealable cap that may cover or uncover the opening as needed.

2 Claims, 3 Drawing Sheets

WRIST-WORN WIPES DISPENSER

BACKGROUND OF THE INVENTION

The present invention is directed toward a wipes dispenser and more particularly, toward a wipes dispenser that may be worn about a person's wrist.

People, in general and parents in particular, often find themselves in need of a wipe or moist towelette. For instance, when dining in a restaurant, a child's face and hands may need to be wiped before and/or after the meal. Adults, as well, may find that they need a moist towelette at a restaurant. Also, when a person is changing a child's diaper, wipes are indispensable. Furthermore, when changing a diaper, it is helpful to have both hands free without having to open a wipes container, which usually requires both hands. Also, a person's hands and face may need to be cleaned when a sink is not readily available such as in a car, in a store, or when using public transportation.

Presently, wipes are available in small, portable pliable packages that fit within a bag or a purse. Wipes are also available in larger plastic containers. However, the larger containers are rather bulky, do not fit well in a bag, and are otherwise not easily transportable and conveniently available.

Several patents have addressed the problem of making wipes convenient to use and carry. For example, U.S. Pat. No. 6,427,839 to Helfer-Grand discloses a dispenser for pre-moistened towelettes. The dispenser includes a compartment that houses a plurality of towelettes that may be dispensed through an opening located in the dispenser. The dispenser may be worn around a person's wrist. However, this dispenser appears to be rather bulky when worn about a person's wrist.

U.S. Pat. No. 4,536,889 to Taylor et al. discloses a facial tissue dispenser worn about a person's wrist where the tissues are dispensed through an opening in the dispenser. However, this dispenser also appears to be rather bulky and may be somewhat cumbersome to wear about a person's wrist.

Therefore, a need exists for a wipes dispenser that may be easily and unobtrusively worn about a person's wrist and that may be easily and conveniently used.

SUMMARY OF THE INVENTION

The present invention is designed to overcome the deficiencies of the prior art discussed above. It is an object of the present invention to provide a wipes dispenser that may be worn unobtrusively about a person's wrist.

It is another object of the present invention to provide a wipes dispenser that is convenient and easy to use.

In accordance with the illustrative embodiments demonstrating features and advantages of the present invention, there is provided a wipes dispenser that includes a generally tubular transparent housing adapted to be worn about a person's wrist. The housing has an opening. A plurality of wipes is contained within the housing to be dispensed through the opening. In a second embodiment the opening is covered with a hinged resealable cap that may cover or uncover the opening as needed Other objects, features, and advantages of the invention will be readily apparent from the following detailed description of the preferred embodiments thereof taken in conjunction with the drawings.

BRIEF DESCRIPTION OF THE DRAWINGS

For the purpose of illustrating the invention, there is shown in the accompanying drawings forms that are presently preferred; it being understood that the invention is not intended to be limited to the precise arrangements and instrumentalities shown.

DETAILED DESCRIPTION OF THE PREFERRED EMBODIMENTS

Figure 3:
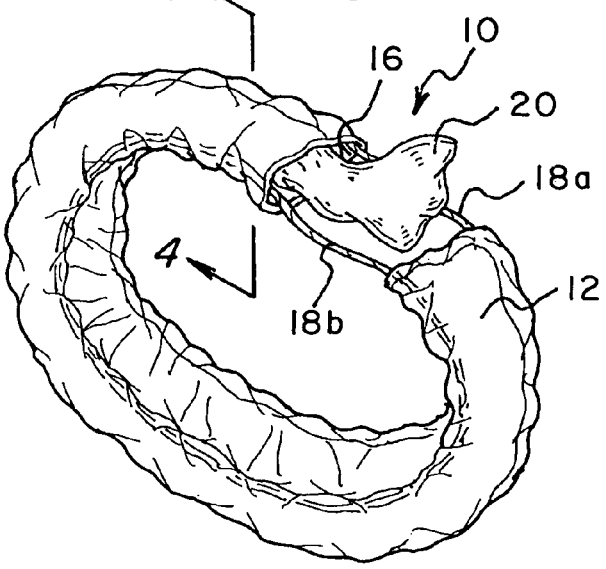
FIG. 3 is a front perspective view similar to FIG. 1 of the dispenser of the first embodiment of the present invention.

Referring now to the drawings in detail wherein like reference numerals have been used throughout the various figures to designate like elements, there is shown in FIG. 3 a wipe dispenser constructed in accordance with the principles of the present invention and designated generally as 10.

Figure 1:
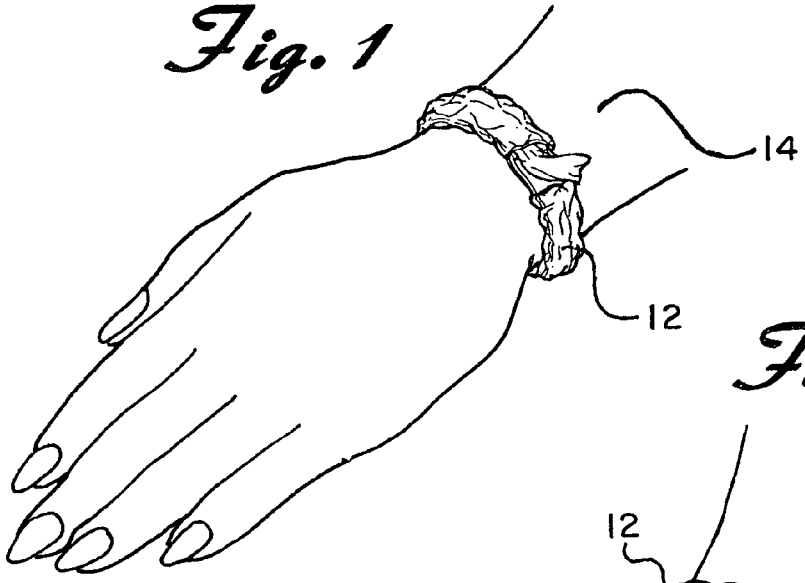
FIG. 1 illustrates a first embodiment of the present invention being worn about a person's wrist.
Figure 2:
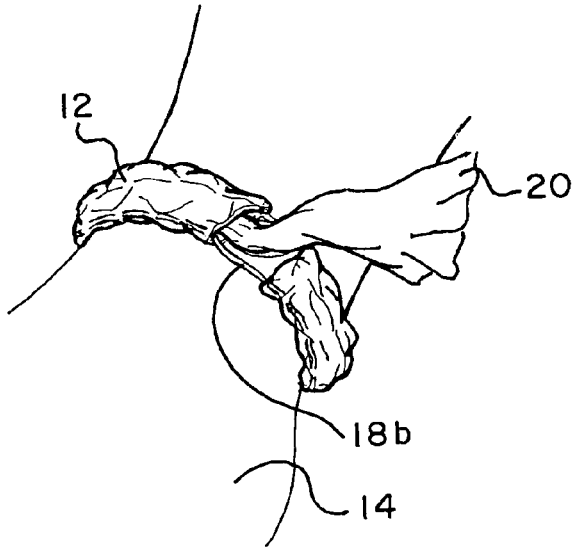
FIG. 2 illustrates a wipe being dispensed from the housing of the first embodiment of the present invention.

The wipe dispenser of the first embodiment of the present invention essentially includes a generally tubular transparent housing 12 adapted to be worn about a person's wrist 14. (See FIGS. 1 and 2.) The housing 12 is preferably made of a thin flexible plastic film material and includes an opening 16. Located within the housing 12 and secured to the walls thereof are elastic strings or bands 18*a* and 18*b* that provide additional support and shape to the housing. The strings 18*a* and 18*b* also allow for the housing 12 to be stretched in order to securely fit a variety of differently sized wrists. A plurality of wipes or moist towelettes 20, for example, is contained within the housing 12.

Figure 4:
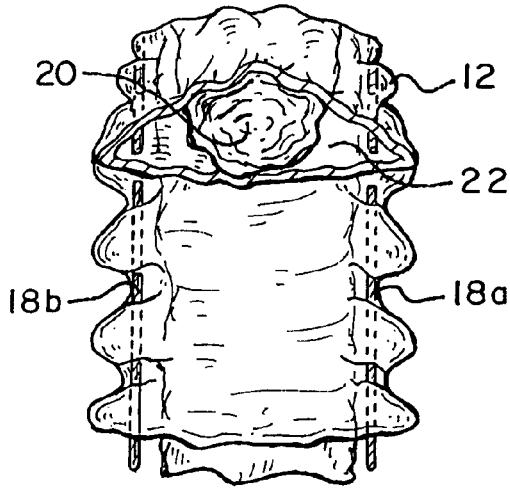
FIG. 4 is a cross-sectional view taken through line 4-4 of FIG. 3.

The opening 16, which is preferably at one end of the tube that forms the housing, may initially be sealed closed with a strip or flap of an adhesive material. When the adhesive material is removed, the opening 16, which may be in the form of a narrow slit 22 is exposed. (See FIG. 4.) Rather than being at an end, as shown, the opening 16 could be in the form of a slit in the side wall of the housing 12. The relatively small opening 16 aids in allowing only one wipe to be dispensed at a time. It should be understood, however, that while this is the preferred embodiment caps, closures and other shapes of openings may be used. In fact, in some embodiments, a cap may be used to cover the opening as described in the second embodiment below.

In order to use the dispenser a person wearing the dispenser first removes the adhesive closure material covering the opening 16 and then pulls the wipe 20 through the opening. (See FIGS. 2 and 3.) The wipes are placed within the housing 12 in a stacked, interspersed formation so that only a single wipe will be dispensed at a time. It is also possible to have the wipes attached to each other end to end with a frangible portion between each of them. As each wipe is pulled out of the opening, the next wipe is pulled into position and the frangible portion in between allows the leading wipe to be easily torn and removed from the remaining wipes.

After a wipe is removed, the adhesive material can be reused to temporarily reseal the opening 16. Alternatively, the opening can simply be left open. Because the opening is relatively small, the wipes will not dry out quickly. Furthermore, the dispenser contains only a limited number of wipes which are intended to be used up within a day or less. Once all of the wipes have been depleted from the housing, the dispenser may be discarded.

Figure 7:
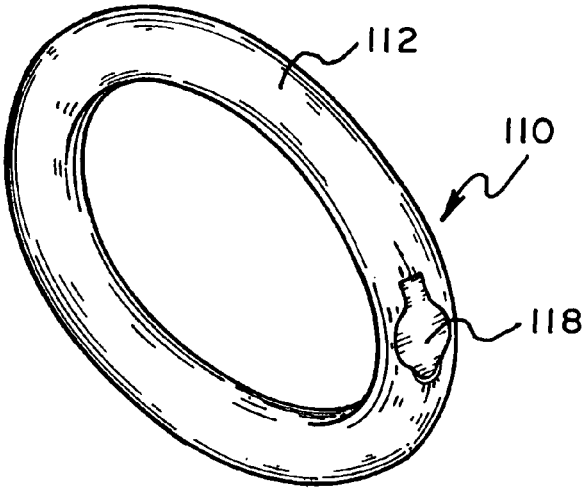
FIG. 7 is a front perspective view similar to FIG. 5 of the dispenser of the second embodiment of the present invention.

The wipe dispenser 110 of the second embodiment of the present invention is shown in FIG. 7. The wipe dispenser 110 is structurally and functionally similar to the dispenser of the first embodiment with the differences described below.

Figure 5:
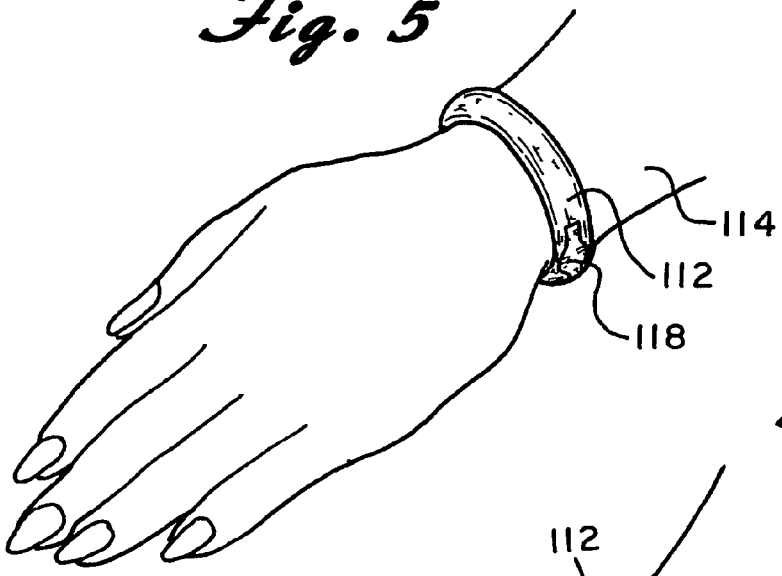
FIG. 5 illustrates a second embodiment of the present invention being worn about a person's wrist.
Figure 6:
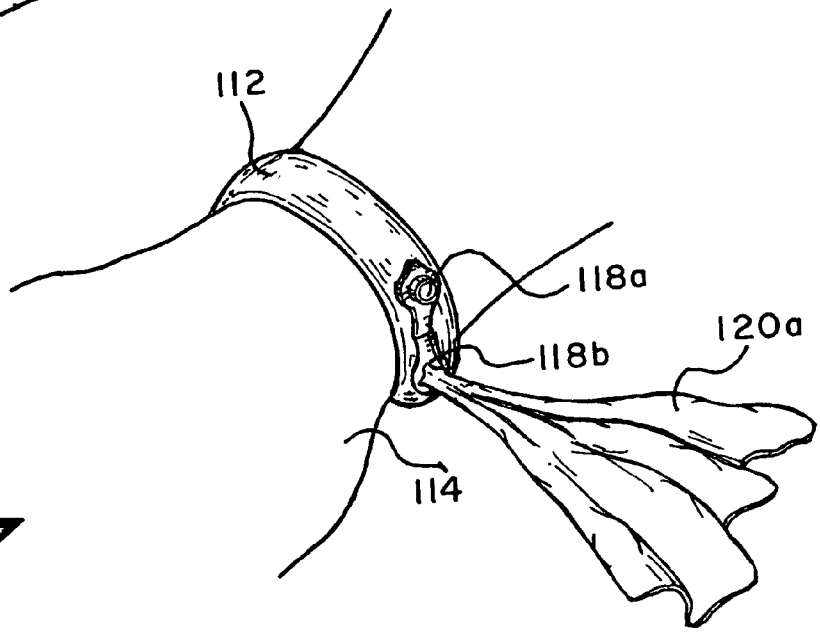
FIG. 6 illustrates a wipe being dispensed from the housing of the second embodiment of the present invention.
Figure 12:
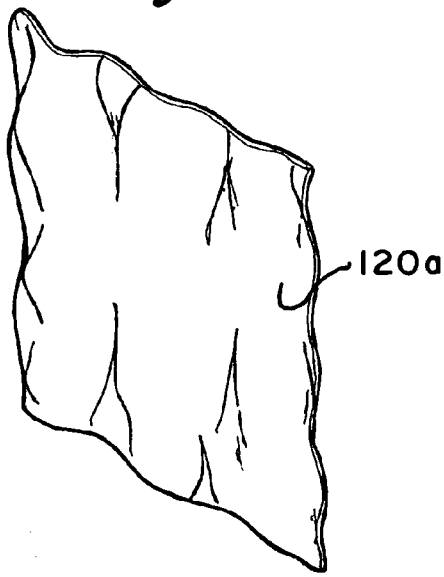
FIG. 12 is a front perspective view of a wipe that has been dispensed from the housing of the present invention.

The dispenser 110 essentially includes a generally tubular transparent housing 112 which may be somewhat more rigid than housing 12 and is adapted to be worn about a person's wrist 114. (See FIGS. 5 and 6.) The housing 112 includes an opening 116 with a hinged resealable cap 118 with a top half 118*a* and a bottom half 118*b* that may cover or uncover the opening 116 as needed. The operation of the cap 118 will be discussed in greater detail below. A plurality of wipes or moist towelettes 120*a*-120*d*, for example, is contained within the housing 112. A typical wipe 120*a* is shown in FIG. 12. The housing 112 may be made from a somewhat rigid plastic material or the like.

Figure 8:
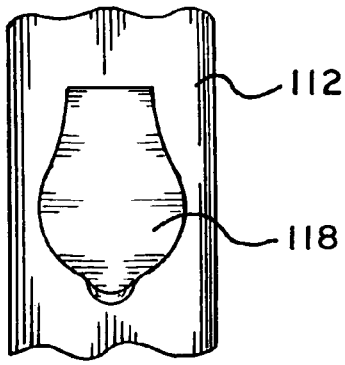
FIG. 8 illustrates the opening of the dispenser of the second embodiment of the present invention in a covered position.
Figure 9:
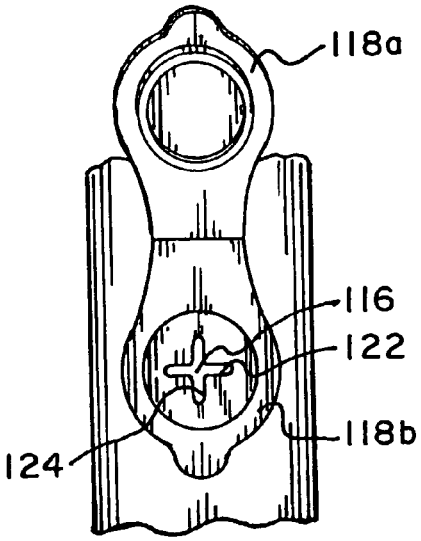
FIG. 9 illustrates the opening of the dispenser of the second embodiment of the present invention in an uncovered position.

In a closed position, shown in FIG. 8, the top half 118*a* of the cap 118 sealingly fits onto the bottom half 118*b* and covers the opening 116. The cap 118 may also be in an open position, as shown in FIG. 9. In the open position the top half 118*a* of the cap 118 is flipped open thereby revealing the opening 116. The opening 16 itself may include two slits 122 and 124 in a cross formation so that the opening 116 is somewhat narrow and aids in allowing only one wipe to be dispensed at a time. It should be understood, however, that while this is the preferred embodiment other types of caps and openings may be used. In fact, in some embodiments, the cap could be eliminated and the opening through which the wipes are dispensed could be uncovered and exposed at all times as described in the first embodiment.

Figure 11:
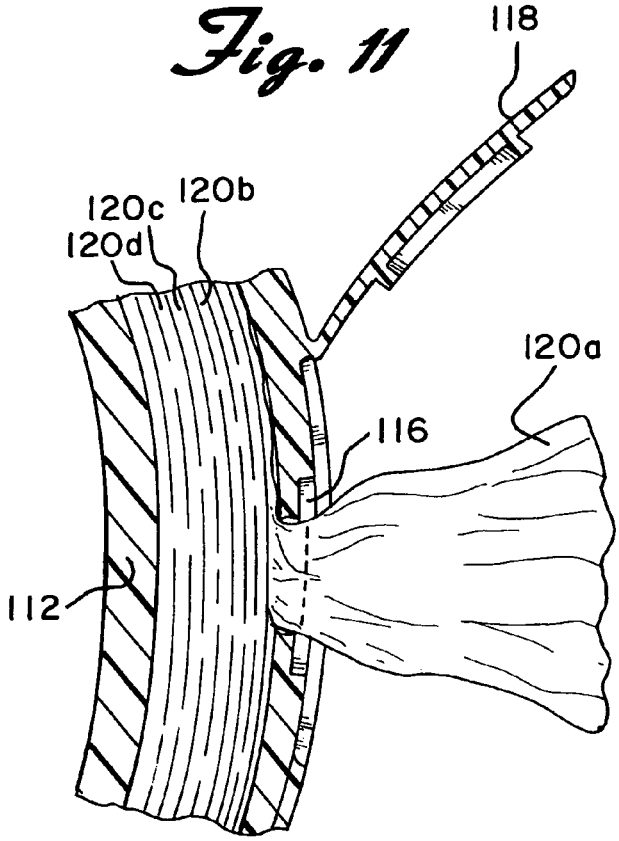
FIG. 11 is a partial cross-sectional view of the dispenser of the second embodiment of the present invention when a wipe is being dispensed.
Figure 10:
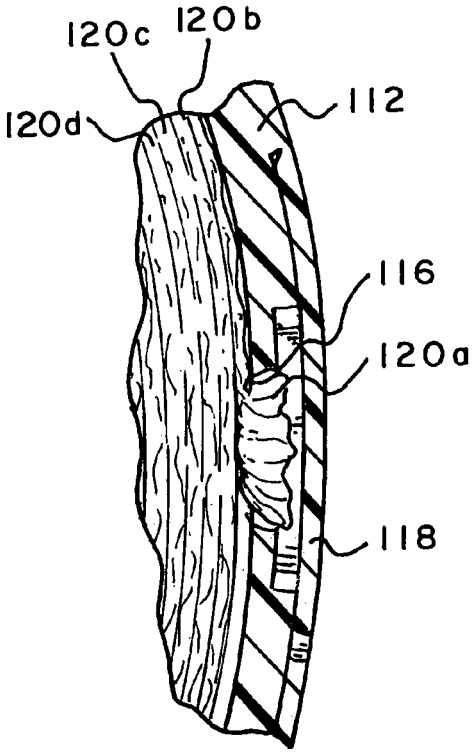
FIG. 10 is a partial cross-sectional view of the dispenser of the second embodiment of the present invention when no wipes are being dispensed.

In order to use the dispenser a person simply flips the cap 118 open when a wipe is needed, thereby revealing the opening 116 with a wipe protruding slightly therefrom. (See FIG. 10.) The person wearing the dispenser pulls the wipe 120*a* through the opening 116. (See FIGS. 6 and 11.) The wipes 120*a*-120*d* are placed within the housing 112 in a stacked, interspersed formation so that only a single wipe will be dispensed at a time. The cap 118 may then be snapped closed over the opening 116. Once all of the wipes have been depleted from the housing, the dispenser may be discarded.

Although the housing in both embodiments is shown as a continuous toroid, it should be readily apparent that it could be made from an elongated tube that is bent into a circle. After being bent, the ends can then be secured together to form a toroid. In this way, the towlettes can be inserted into the tube before it is bent into a circle.

The present invention may be embodied in other specific forms without departing from the spirit or essential attributes thereof and accordingly, reference should be made to the appended claims rather than to the foregoing specification as indicating the scope of the invention.

We claim:

1. A wrist-worn wipes dispenser comprising:

a generally tubular substantially enclosed toroidally shaped housing, said housing having an opening, a plurality of moist wipes contained within said housing, and means for releasably sealing said opening, wherein said housing is adapted to be worn about a person's wrist and prevents said moist wipes from drying out quickly, said housing being comprised of a substantially transparent flexible plastic film material and having elastic means therein that allows said housing to be stretched in order to fit over a variety of different size wrists.

2. The wrist-worn wipes dispenser of claim 1 wherein said releasable sealing means includes adhesive means a for temporarily covering said opening.

* * * * *